US007000540B2

(12) United States Patent
Conzelmann et al.

(10) Patent No.: US 7,000,540 B2
(45) Date of Patent: Feb. 21, 2006

(54) METHOD OF OPERATING A MACHINE PROCESSING PRINTING MATERIAL SHEETS

(75) Inventors: Daniel Conzelmann, Dielheim (DE); Karl-Heinz Helmstädter, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/822,024

(22) Filed: Apr. 8, 2004

(65) Prior Publication Data

US 2004/0255802 A1 Dec. 23, 2004

(30) Foreign Application Priority Data

Jun. 18, 2003 (DE) ..... 103 27 422

(51) Int. Cl.
*B41F 5/02* (2006.01)

(52) U.S. Cl. ..... 101/230; 101/246; 101/409; 101/410; 101/411; 101/232; 271/277

(58) Field of Classification Search ..... 101/230, 101/246, 409, 410, 411, 232; 271/277
See application file for complete search history.

(56) References Cited

U.S. PATENT DOCUMENTS

| | | | | |
|---|---|---|---|---|
| 2,366,930 A | * | 1/1945 | Pirie | 74/613 |
| 3,796,154 A | * | 3/1974 | Weisgerber | 101/232 |
| 4,014,260 A | * | 3/1977 | Schroter-Dommes et al. | 101/212 |
| 4,217,824 A | * | 8/1980 | Rebel et al. | 101/375 |
| 4,723,489 A | * | 2/1988 | Emrich et al. | 101/230 |
| 4,735,142 A | | 4/1988 | Haupenthal | |
| 4,815,379 A | | 3/1989 | Becker et al. | |
| 4,815,380 A | * | 3/1989 | Fischer | 101/375 |
| 5,579,691 A | | 12/1996 | Voge | |
| 5,901,955 A | * | 5/1999 | Klopfenstein | 271/277 |
| 6,082,260 A | | 7/2000 | Friedrichs et al. | |
| 6,182,960 B1 | * | 2/2001 | Keller et al. | 271/82 |
| 6,722,276 B1 | * | 4/2004 | Helmstadter | 101/230 |

FOREIGN PATENT DOCUMENTS

| | | |
|---|---|---|
| DE | 31 26 103 A1 | 6/1982 |
| DE | 35 35 621 C2 | 4/1987 |
| DE | 195 46 311 A1 | 6/1996 |
| EP | 0 185 965 B1 | 7/1986 |
| EP | 0 230 032 B1 | 7/1987 |
| EP | 0 839 649 B1 | 5/1998 |

* cited by examiner

*Primary Examiner*—Daniel J. Colilla
*Assistant Examiner*—Andrea H. Evans
(74) *Attorney, Agent, or Firm*—Laurence A. Greenberg; Werner H. Stemer; Ralph E. Locher

(57) ABSTRACT

In a method of operating a machine processing printing material sheets and having a sheet transport drum in various operating modes, drum circumferential shells are kept fixed on the sheet transport drum in an outer position in a first of the operating modes and in an inner position in a second of the operating modes. During a drum conversion to be carried out before the start of a third of the operating modes, the drum circumferential shells are removed from the sheet transport drum and, in this third operating mode, the sheet transport drum is rotated without the drum circumferential shells.

10 Claims, 6 Drawing Sheets

METHOD OF OPERATING A MACHINE PROCESSING PRINTING MATERIAL SHEETS

BACKGROUND OF THE INVENTION

Field of the Invention

The present invention relates to a method of operating a machine processing printing material sheets and having a sheet transport drum in various operating modes. Drum circumferential shells are held fixed on the sheet transport drum in an outer position in a first of the operating modes and in an inner position in a second of the operating modes.

Adapting the drum profile of a sheet transport drum to the various types of printing materials is necessary to be able to process printing materials all in one and the same sheet-fed press. For this reason, what are referred to as vario drums with a variable drum profile have been developed. Such a vario drum is used with a substantially circular drum profile for paper sheets and with a narrowed drum profile for relatively rigid board sheets. By such a variation in the drum profile, with respect both to the paper sheets and to the board sheets, smearing of the printed image from the respective printing material sheet onto the sheet transport drum is avoided.

In European Patent 0 185 965 B1, which forms the closest prior art, a description is given of a vario drum whose drum profile can be set to be substantially circular by pivoting drum circumferential shells into an outer position and can be set to be narrow by pivoting the drum circumferential shells into an inner position. One disadvantage of this vario drum is that its drum profile cannot be set narrow enough for extremely rigid printing material sheets by folding in the drum circumferential shells, and, because of the construction, the drum circumferential shells are fitted to the vario drum in every conceivable operating mode of the latter, as a result of which, maintenance work to be carried out on the machine and the drum circumferential shells can be carried out only under conditions that are made more difficult.

European Patent 0 230 032 B1, corresponding to U.S. Pat. No. 4,815,379 to Becker et al., describes a vario drum whose drum profile can be imparted a narrow outline by removing the drum circumferential shells and can be imparted a substantially circular outline again as desired by fitting the drum circumferential shells. The unfavorable factor with this vario drum is that every change in its drum profile entails time-consuming conversion work, and that the vario drum can be operated only in two operating modes, namely, an operating mode with the drum circumferential shells mounted and an operating mode with the drum circumferential shells removed.

SUMMARY OF THE INVENTION

It is accordingly an object of the invention to provide a method of operating a machine processing printing material sheets that overcomes the hereinafore-mentioned disadvantages of the heretofore-known devices and methods of this general type and that has a sheet transport drum in various operating modes that permits the processing of extremely rigid printing material sheets in the machine and simple maintenance.

With the foregoing and other objects in view, there is provided, in accordance with the invention, a method of operating a machine processing printing material sheets and having a sheet transport drum operating in various operating modes, drum circumferential shells being held fixed on the sheet transport drum in an outer position in a first of the operating modes and in an inner position in a second of the operating modes. During a drum conversion to be carried out before the start of a third of the operating modes, the drum circumferential shells are removed from the sheet transport drum and, in this third operating mode, the sheet transport drum is rotated without the drum circumferential shells.

With the objects of the invention in view, there is also provided a method of operating a machine processing printing material sheets, including the steps of providing a sheet transport drum of the printing machine with drum circumferential shells, operating the sheet transport drum in various operating modes, in a first of the operating modes, fixing the drum circumferential shells in an outer position on the sheet transport drum, in a second of the operating modes, fixing the drum circumferential shells in an inner position on the sheet transport drum, before a start of a third of the operating modes, removing the drum circumferential shells from the sheet transport drum during a drum conversion, and, in the third operating mode, rotating the sheet transport drum without the drum circumferential shells.

With the objects of the invention in view, there is also provided a method of operating a machine processing printing material sheets, including the steps of operating a sheet transport drum of a printing machine in different modes to fix drum circumferential shells on the sheet transport drum in an outer position in a first of the operating modes, to fix the drum circumferential shells on the sheet transport drum in an inner position in a second of the operating modes, and to remove the drum circumferential shells from the sheet transport drum during a drum conversion to be carried out before the start of a third of the operating modes and to rotate the sheet transport drum without the drum circumferential shells in the third operating mode.

In the method according to the invention, in the inner position, the drum circumferential shells are located closer to an axis of rotation of the sheet transport drum than in the outer position, and that the drum profile of the sheet transport drum in the second operating mode is certainly narrower or set back radially further than in the first operating mode, but is less narrow and set back radially less than in the third operating mode.

Accordingly, the method is extremely suitable, with respect to the risk of smearing, to transport a less problematic printing material sheet, such as a flexible paper sheet, by the sheet transport drum in the first operating mode, to transport completely unproblematic, "normal" printing material sheets, such as relatively rigid board sheets, in the second operating mode, and to transport very problematic printing material sheets, such as extremely rigid plastic sheets, in the third operating mode. Such an organization into at least three operating modes that differ from one another with respect to the drum profile used in each case meets the requirements of many print shops whose print job range requires the printing of print jobs requiring the unproblematic printing material sheets. Such jobs are, as a rule, by far the greatest proportion of all the print jobs, the printing of print jobs requiring a less problematic printing material sheet, which do not occur so often, and the printing of the print jobs requiring the very problematic printing material sheets, which are extremely rare.

An additional advantage of the method according to the invention is to be seen in the fact that the drum circumferential shells can be kept outside the machine during the third operating mode. For example, during the third operating mode, the drum circumferential sheets can be cleaned outside the machine or contaminated anti-smear protective coverings, with which the drum circumferential shells can be covered, can be replaced by clean anti-smear protective coverings.

Such maintenance work can, often, be carried out by the operating personnel outside the machine with much less difficulty than within the machine.

The drum circumferential shells are fitted to the sheet transport drum both in the first operating mode and in the second operating mode and impart to the sheet transport drum a substantially circular drum profile in the first operating mode and, in the second operating mode, a drum profile that differs substantially from the circular shape and, for example, is elongated or substantially polygonal.

In accordance with another mode of the invention, the position change of the drum circumferential shells carried out between the first and the second operating mode can be effected by uninstalling the drum circumferential shells from one position (e.g., outer position) and subsequent reinstallation of the drum circumferential shells in their respective other position (e.g., inner position). In such a case, for the purpose of their position change, the drum circumferential shells are, therefore, first released from the sheet transport drum and then fitted to the sheet transport drum again with a placement changed with respect to the previous placement.

Sub developments are explained briefly in detail below.

Advantageous with regard to the minimization of the machine stoppage times are developments according to which the drum circumferential shells in the first operating mode and in the second operating mode are carried by adjustable carriers belonging to the sheet transport drum and, during a change of the operating mode carried out between the first and second operating modes, each of the drum circumferential shells is adjusted into the required one of the positions together with one of the adjustable carriers in each case. Consequently, no time-consuming mounting work is necessary to convert the sheet transport drum either from the first operating mode to the second operating mode or from the second operating mode to the first operating mode, and the drum circumferential shells do not need to be released from the sheet transport drum. If the sheet transport drum has last been used in the first operating mode and is, subsequently, to be used in the second operating mode, then, for this change in the operating mode, it is merely necessary to adjust one of the drum circumferential shells together with the adjustable carrier carrying the drum circumferential shell into the inner position and, either after that or, preferably, simultaneously, to adjust the other drum circumferential shell together with the other adjustable carrier carrying the latter likewise into the inner position. Otherwise, if the sheet transport drum is to be used in the first operating mode following the second operating mode then, for this change in the operating mode, only an adjustment, carried out either one after another or, preferably, simultaneously, of the drum circumferential shell/adjustable carrier pairs into the outer position is required.

In a development that is advantageous with regard to the mutually synchronized adjustment of the drum circumferential shells, swinging arms of coupler mechanisms belonging to the sheet transport drum are used as the adjustable carriers. The coupler mechanisms can in each case be of the four rotary joint chain type and include a common drive-swinging arm. The swinging arms functioning as the adjustable carriers can be the output swinging arms of the coupler mechanisms. The coupler mechanisms and their swinging arms are, therefore, used to pivot the drum circumferential shells optionally into a position close to the drum center and into a position remote from the drum center.

In a development that is advantageous with regard to the low overall space required for this purpose and the low fabrication costs required for this purpose, during the drum conversion used to set up the sheet transport drum for the third operating mode, the adjustable carriers are used to guide the drum circumferential shells by the drum circumferential shells being moved along the adjustable carriers and being guided by the latter in the process. On account of the multifunctionality of the adjustable carriers provided in accordance with the developments described here, guides separate from the adjustable carriers are dispensable. During the drum conversion, each of the drum circumferential shells slides or rolls on another of the adjustable carriers, at this time, the corresponding drum circumferential shells already no longer being fixed to the sheet transport drum by a holder belonging to the latter. The guidance of the drum circumferential shells by the adjustable carriers is, preferably, carried out successively so that, firstly, one drum circumferential shell is guided along the adjustable carrier associated with this drum circumferential shell and, then, the other drum circumferential shell is guided along the adjustable carrier associated with the latter. In the process, the drum circumferential shells are guided away from the sheet transport drum. Of course, the adjustable carriers can also be used to guide the drum circumferential shells along the adjustable carriers in the opposite direction, that is to say, toward the sheet transport drum again, during the setting up of the sheet transport drum for the first or second operating mode, starting from the third operating mode.

In a development that is advantageous with regard to a constructionally optimal configuration of the sheet transport drum, during the drum conversion used to set up the sheet transport drum of the third operating mode, guides disposed separately from the adjustable carriers on the sheet transport drum, that is to say, not the adjustable carriers themselves, are used to guide the drum circumferential shells, by the drum circumferential shells being moved along the guides and being guided by the latter. Because, according to this development, use is made of guides that are different from the adjustable carriers and that, for example, can be disposed on the sheet transport drum beside the adjustable carriers, both these guides and the adjustable carriers can be configured for their respective specific task without any constructional compromise. The guides can be configured optimally with regard to the course of their curvilinearly curved or linear guide tracks, to guide the drum circumferential shells either simultaneously or, preferably, successively away from the sheet transport drum in preparation for the third operating mode and, after the third operating mode has been carried out, toward the sheet transport drum again. During the guidance of the drum circumferential shells, carried out by the guides, the former are in each case released from the sheet transport drum, that is to say, the respectively guided drum circumferential shell is either already no longer secured or not yet secured again in the holder associated with it and belonging to the sheet transport drum. The guides can be sliding or rolling guides and can be disposed immovably on side plates of the sheet transport drum such that the adjustment of the adjustable carriers into the inner or outer position is carried out without concomitant adjustment of the guides. The task assigned to the adjustable carriers according to the development described here lies in the adjustment, carried out with the drum circumferential shells secured by the holders, of just these drum circumferential shells optionally outward for the first operating mode and inward for the second operating mode, and in supporting the drum circumferential shells both in the first operating mode and in the second operating mode.

In a development that is advantageous with regard to the use of a conveying device separate from the sheet transport drum for conveying the drum circumferential shells away from the sheet transport drum before the start of the third operating mode and toward the sheet transport drum again after the completion of the third operating mode, the guidance of the drum circumferential shells carried out by the adjustable carriers themselves in accordance with one development described previously, and carried out by guides separate from the adjustable carriers according to the other development described previously, is in each case carried out with the sheet transport drum not rotating. However, rotation of the sheet transport drum during the drum conversion, required in preparation for the third operating mode, from a first rotary angle position, in which one adjustable carrier is located opposite the conveying device disposed beside the sheet transport drum, into a second rotary angle position, in which the other adjustable carrier faces the conveying device adjacent to the sheet transport drum, is not ruled out. By such a rotary angle position change, first of all, one and, then, the other adjustable carrier can be brought into a rotary angle position that is beneficial to discharging or picking up the respective drum circumferential shell to or from the conveying device. The conveying device coordinated with the sheet transport drum can be used for the purpose of transporting the drum circumferential shells from the sheet transport drum to a magazine of the machine before the start of the third operating mode and, after the conclusion of the third operating mode, for the purpose of transporting the drum circumferential shells back from the magazine to the sheet transport drum again. In such a case, the magazine would be used for the storage of the drum circumferential shells outside the drum but inside the machine during the third operating mode.

In a development that is advantageous with regard to dispensing with an additional conveying device for conveying the drum circumferential shells, during the drum conversion for the third operating mode, the drum circumferential shells are pushed away from the sheet transport drum by rotational movements of the latter. The sheet transport drum, thus, functions as an "ejector" for its drum circumferential shells and, with a first rotary movement, pushes one drum circumferential shell and, with a second rotary movement, pushes the other drum circumferential shell away from itself. During such displacement, the point of action of the thrust force exerted on the respective drum circumferential shell by the sheet transport drum can be located either at that end of the circumferential shell that leads during operation, for example, during printing operation, or that which trails during operation. The end of the circumferential shell opposite this end of the circumferential shell is released from the sheet transport drum first, is located in front as viewed in the direction in which the drum circumferential shell is displaced, and is able to be guided during the ejection by a drum circumferential shell guide that is separate from the sheet transport drum. This drum circumferential shell guide, disposed beside the sheet transport drum, can be used to feed the drum circumferential shells into the machine store that is separate from the sheet transport drum, in which the drum circumferential shells can be kept temporarily during the progress of the third operating mode.

Advantageous with respect to relieving the load on the operating personnel arising from conversion work to be carried out manually is a development according to which, during the drum conversion, the holders previously already mentioned, by which the drum circumferential shells are held on the sheet transport drum in the first and second operating modes, are released automatically by in each case a relative movement carried out between the sheet transport drum and at least one machine element separate from the sheet transport drum. These relative movements can be rotations of the sheet transport drum carried out relative to the machine element or the machine elements, or adjustments of the machine element or of the machine elements carried out relative to the sheet transport drum. As a result of the relative movements, the machine element comes into actuating contact with the holders in each case and the holders are opened as a result so that they release the drum circumferential shells. The machine element used can be the drum circumferential shell guide already mentioned, which can be disposed beside the sheet transport drum such that it can move. If a plurality of machine elements is used to release the holders, each of which elements is brought into actuating contact with another of the holders by one of the relative movements, these machine elements can be formed by a plurality of drum circumferential shell guides disposed beside the sheet transport drum such that they can move. The drum circumferential shell guide(s) can belong to the conveying device used to convey the drum circumferential shells.

As already indicated, in the third operating mode, the printing material sheets are transported by the rotating sheet transport drum. In such a case, the third operating mode can be a printing operating mode.

In accordance with a concomitant mode of the invention, in the third operating mode, the sheet transport drum is rotated for a maintenance purpose. Such rotation of the sheet transport drum, carried out for the maintenance purpose, can take place without the drum transporting a printing material sheet. The third operating mode can, therefore, be a maintenance mode in which the machine is operated. For instance, if the maintenance is cleaning of a machine part adjacent to the sheet transport drum, for example, a sheet guide device disposed underneath the sheet transport drum, then the sheet transport drum can be adjusted, by the rotation carried out in the third operating mode, into a rotational position in which trouble-free access to the machine part is possible, uninhibited by the sheet transport drum.

Other features that are considered as characteristic for the invention are set forth in the appended claims.

Although the invention is illustrated and described herein as embodied in a method of operating a machine processing printing material sheets, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1A:
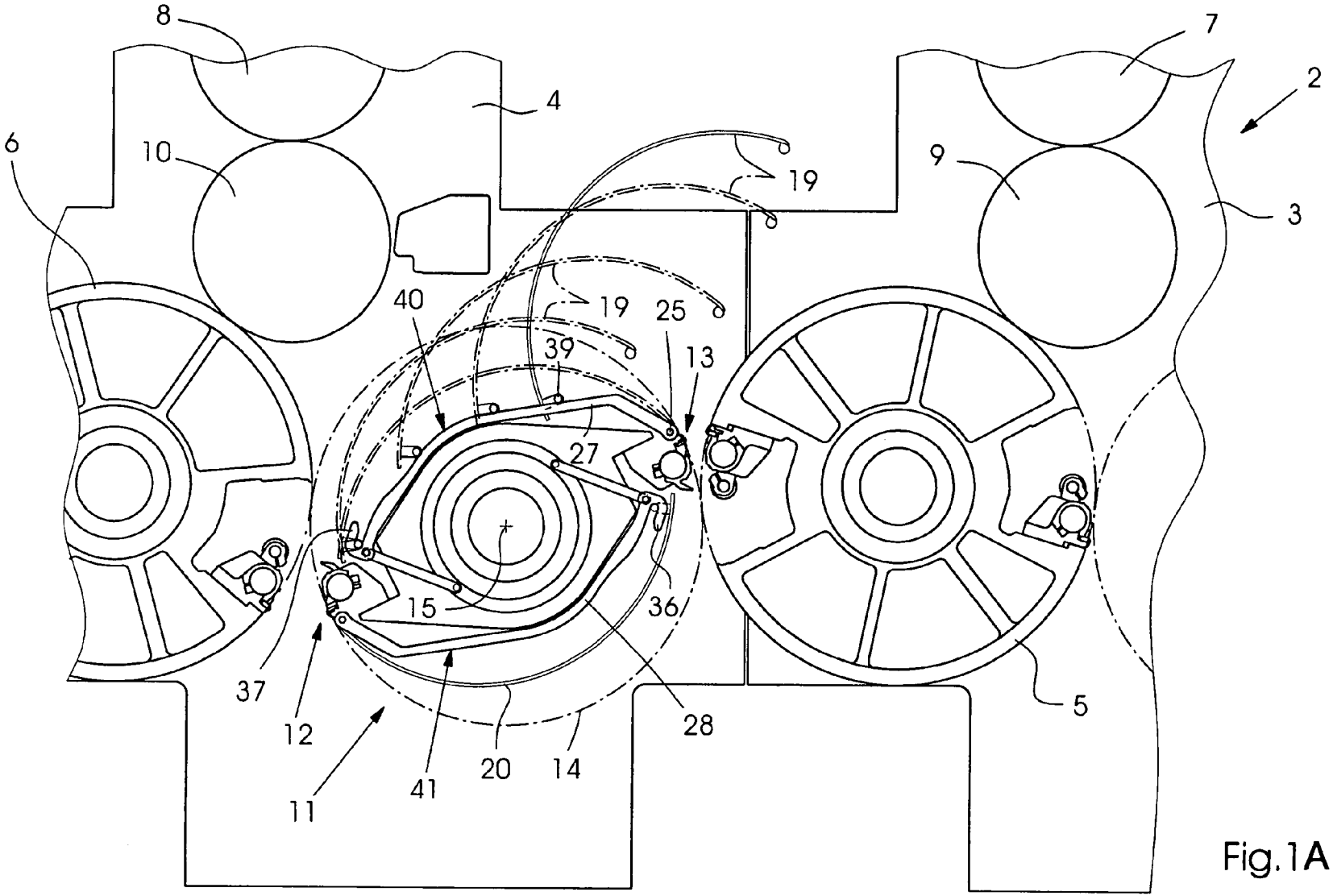
FIG. 1A is fragmentary, cross-sectional view of a first exemplary embodiment of a machine according to the invention, in which, during a drum conversion, drum circumferential shells are removed from a sheet transport drum with their adjustable carriers being used as guides to guide the drum circumferential shells.

Referring now to the figures of the drawings in detail and first, particularly to FIGS. 1A to 4 thereof, there is shown machines 2 processing printing material sheets 1 (see FIG. 1B), the construction and functional features of the machines first being described herein.

Each machine 2 is a sheet-fed press of inline construction and includes an upstream printing unit 3 and at least one downstream printing unit 4. Each printing unit 3, 4 includes a double-size impression cylinder 5, 6 and a printing plate cylinder 7, 8. Although each printing unit 3, 4 could be constructed as a flexographic printing unit for varnishing, it is, instead, constructed as an offset printing unit. Accordingly, each printing unit 3, 4 includes a blanket cylinder 9, 10, which is disposed between the other two cylinders 5, 7 and 6, 8. Disposed between the impression cylinders 5, 6 is a sheet transport drum 11, which picks up the printing material sheets 1 from the upstream impression cylinder 5 and transfers them to the downstream impression cylinder 6. The sheet transport drum 11 is of multiple size, specifically, double size, and has two diametrically disposed gripper systems 12, 13 for clamping the printing material sheets 1. During drum rotation, the gripper systems 12, 13 describe an imaginary gripper flight circle 14 about an axis of rotation 15.

Figure 1B:
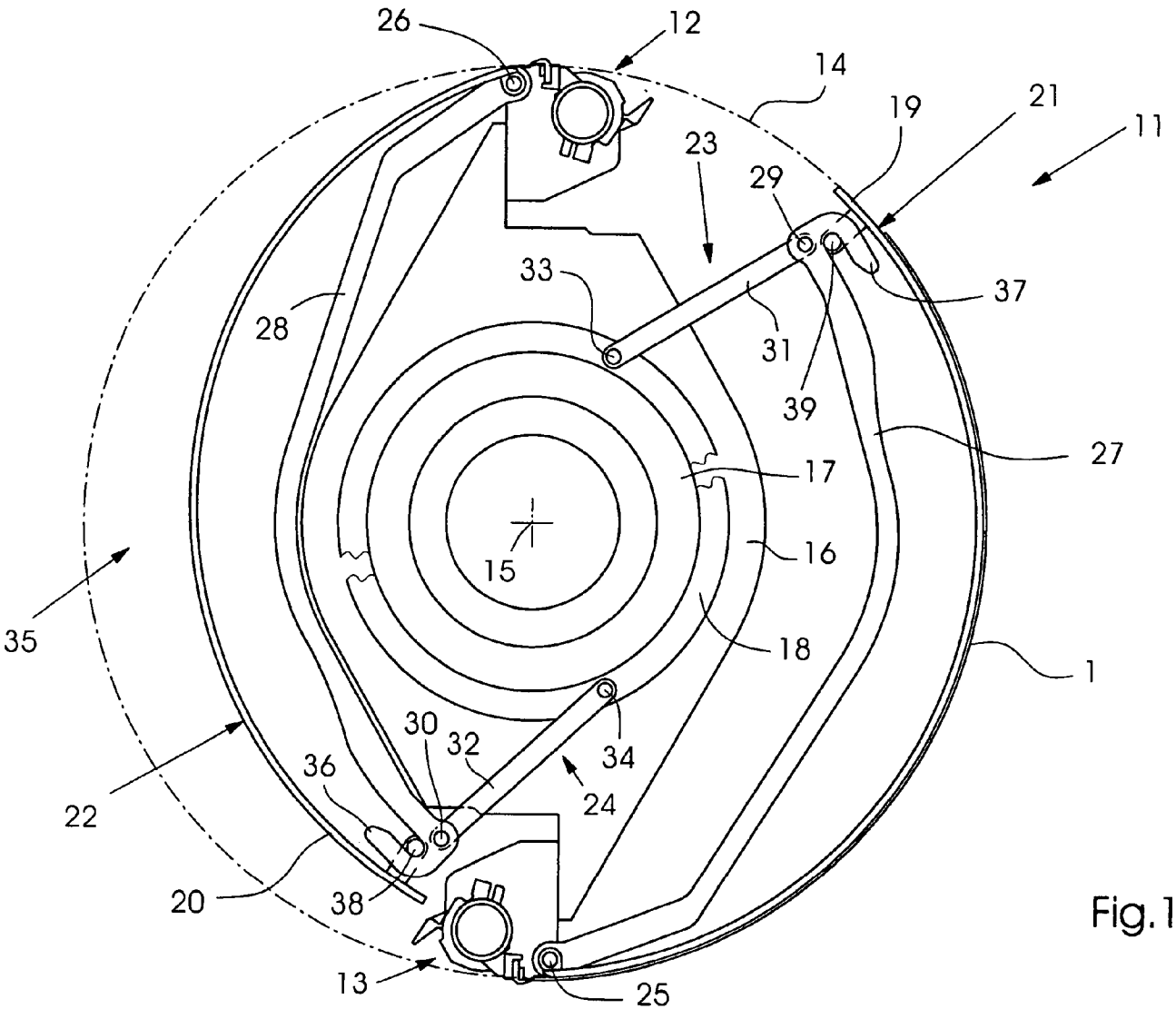
FIG. 1B is an enlarged cross-sectional view of the sheet transport drum of FIG. 1A including the drum circumferential shells before their removal.

FIG. 1B shows that the sheet transport drum 11 has a basic body 16 and an axle journal 17, on which an annular drive element 18 is mounted such that it can be rotated about the axis of rotation 15. The sheet transport drum 11 also includes drum circumferential shells 19, 20, whose radius of curvature corresponds substantially to that of the gripper flight circle 14. The drum circumferential shells 19, 20 are used to carry the printing material sheets in a first operating mode of the machine 2 and are, therefore, equipped with anti-smear surfaces 21, 22.

On account of their materials and and/or relief composition, the anti-smear surfaces 21, 22 possess a property that repels the still fresh printing ink on printing material sheets 1 that have not yet dried sufficiently. The anti-smear surfaces 21, 22 can be of, for example, chromium or another ink-repellent material with which the drum circumferential shells 19, 20 are coated and/or can be provided with a micro-roughness or macro-structure that acts in an ink-repellent manner. The anti-smear surfaces 21, 22 can also be formed by a textile material with which the drum circumferential shells 19, 20 are covered or clad, whose fabric forms the ink-repellent relief and/or that is provided with an ink-repellent impregnation.

Each drum circumferential shell 19, 20 is respectively associated with a coupler mechanism 23, 24, by which the respective drum circumferential shell 19 or 20 can be pivoted optionally about a rotary joint 25 or 26 into an outer position for the first operating mode and into an inner position provided for the second operating mode. In FIG. 1B, the outer position is illustrated using the example of one drum circumferential shell 19 and the inner position is illustrated using the example of the other drum circumferential shell 20. However, it goes without saying that both the drum circumferential shells 19, 20 simultaneously assume the outer position in the first operating mode and simultaneously assume the inner position in the second operating mode.

The coupler mechanisms 23, 24 form a mechanism disposed on one machine side, for example, what is referred to as the drive side. On the opposite machine side, what is referred to as the operating side in the given example, the sheet transport drum 11 has a mechanism that is the mirror image of this mechanism, which is not visible in the drawing because it is hidden and which, likewise, is of two coupler mechanisms. The two mechanisms are in each case disposed outside the range of the maximum sheet format width.

By the rotary joints 25, 26, adjustable carriers 27, 28, which carry the drum circumferential shells 19, 20 in the first and second operating modes, are connected to the basic body 16. The adjustable carriers 27, 28 are (output) swinging arms belonging to the coupler mechanisms 23, 24 and are substantially bow-shaped. At the ends of the adjustable carriers 27, 28 that are opposite the rotary joints 25, 26, couplers 31, 32 are attached by further rotary joints 29, 30 and are, in turn, attached by their coupler ends opposite these rotary joints 29, 30 to the central drive element 18 through other rotary joints 33, 34. The fact that the rotary joints 33, 34 are actually disposed diametrically can be seen from FIGS. 1A, 2, 3A, and 4, but cannot readily be seen in FIG. 1B on account of the fact that both positions are illustrated simultaneously in the latter.

The drive element 18 is a common drive swinging arm belonging to the coupler mechanisms 23, 24, which are, therefore, of a structure corresponding to the four rotary joint chain, and can be actuated manually or by a motor for the purpose of changing the operating mode. Rotation of the drive element 18 in a clockwise direction (with respect to FIG. 1B) effects synchronous folding out of the adjustable carriers 27, 28 and, with these, of the drum circumferential shells 19, 20 into the outer position, in which the sheet support surfaces (anti-smear surfaces 21, 22) of the drum circumferential shells 19, 20 are substantially coincident with the gripper flight circle 14. Rotation of the drive element 18 in the counterclockwise direction effects synchronous folding in of the coupler mechanisms 24, 25 and drum circumferential shells 19, 20 into the inner position, in which a drum profile of the sheet transport drum 11 is definitively determined by the folded-in drum circumferential shells 19, 20 and is substantially oval, and in which the drum circumference surfaces 19, 20 together with the gripper flight circle 14 bound sickle-shaped clearances 35.

By the clearances 35, freedom of movement for the trailing edges of the printing material sheets 1 is ensured during the action of picking up the printing material sheet 1 carried out by the sheet transport drum 11 by the downstream impression cylinder 6 in the second operating mode. However, the clearances 35 are not large enough for specific, in particular, extremely rigid, printing material sheet types and, therefore, the drum circumferential shells 19, 20 can be removed from the adjustable carriers 27, 28 for the processing of these very problematic printing material sheets, carried out in a third operating mode.

In the third operating mode, the basic body 16 rotates with its coupler mechanisms 23, 24, that is to say, without the drum circumferential shells 19, 20, and the shells 19, 20 are stored temporarily outside or, preferably, inside the machine 2. The external contour of the drum profile is determined definitively by the basic body 16 and/or the adjustable carriers 27, 28 in the third operating mode and, at the same time, is substantially oval or rhomboidal. The sickle-shaped clearances 35 present between the "residual drum" and the gripper flight circle 14 in the third operating mode are considerably wider than the clearances 35 present in the second operating mode and, therefore, offer the trailing edges of the problematic printing material sheets leaving the sheet transport drum 11 sufficient movement space to relieve the stress on the sheets.

Because the coupler mechanisms 23, 24 are disposed outside the maximum sheet format width, the movement space offered to the sheet trailing edge is in no way restricted by these coupler mechanisms 23, 24. The trailing edge of the printing material sheet respectively leaving the sheet transport drum 11 can move without contact and free of collision between the respective one of the coupler mechanisms 23, 24 and the matching piece of this coupler mechanism disposed on the opposite machine side.

At their ends opposite the rotary joints 25, 26 and connected in a jointed manner to the couplers 31, 32, the adjustable carriers 27, 28 are provided with hooks 36, 37 for holding the drum circumferential shells 19, 20. At their circumferential shell ends held by the hooks 36, 37, the drum circumferential shells 19, 20 are equipped with bolt-like engagement elements 38, 39, which engage in the hooks 36, 37 in the first and second operating modes and, as a result, lock the drum circumferential shells 19, 20.

With respect to the manner in which the drum conversion is carried out in preparation for the third operating mode and the removal of the drum circumferential shells 19, 20 from the sheet transport drum 11 is carried out, in addition to some common features, there are also specific differences between the exemplary embodiments, which will, therefore, be described further in detail in the following text.

In the exemplary embodiment according to FIGS. 1A and 1B, the adjustable carriers 27, 28 are used to guide the drum circumferential shells 19, 20 during the removal of the shells 19, 20.

In a first step, the rotational movement of the sheet transport drum 11 is stopped so that the drum 11, thereafter, remains in its rotary angle position shown in FIG. 1A, in which the drum profile is set obliquely relative to the horizontal a way that the gripper system 12 facing the downstream impression cylinder 6 is located somewhat below and the other gripper system 13 somewhat above the axis of rotation 15. If the second operating mode immediately precedes the third operating mode, the adjustable carriers 27, 28 and the drum circumferential shells 19, 20 are in their inner position required for the imminent drum conversion, as shown in FIG. 1A. Otherwise, between the first and a second step, an intermediate step is necessary, in which the sheet transport drum 11 is folded together for the purpose of setting the inner position.

In the second step, already mentioned, a drum circumferential shell end that leads during printing operation of the drum circumferential shell 19 and that now points substantially upward is released or unlocked by using the quick-acting closure locking the adjustable carrier 27. The rotary joint 25 not only forms a movable holder of the drum circumferential shell 19 but also the aforesaid quick-acting closure. Opening the quick-acting closure can be effected, for example, by withdrawing a joint pin of the rotary joint 25 from a section of a bore in the rotary joint 25, which section is introduced into the drum circumferential shell 19.

As distinct from the exemplary embodiment illustrated in the drawing, however, there can also be a quick-acting closure separate from the rotary joint 25, and this quick-acting closure can be disposed on the adjustable carrier 27, offset along the latter with respect to the rotary joint 25.

Following the opening action, the leading circumferential shell end is free and, in a third step, is moved away from the "residual drum" and its adjustable carrier 27. This removal movement is carried out in a number of movement phases, which are indicated in FIG. 1A by phantom lines.

In a first movement phase, the drum circumferential shell 19 is pivoted outward somewhat around the engagement element 39 still held in the hook 37. The hooks 36, 37 in the exemplary embodiment described here in accordance with FIGS. 1A and 1B (and, incidentally, also in the other exemplary embodiment according to FIG. 2) substantially open only toward the opposite end of the respective adjustable carrier 27, 28 and, in the first and second operating modes, function as the holders of the trailing circumferential shell ends while, at the same time, the rotary joints 25, 26 function as the holders for the leading circumferential shell ends.

In further movement phases that follow the first movement phase, the drum circumferential shell 19 continues to be pivoted increasingly outward but, in the process, is, at the same time, pulled along the adjustable carrier 27. In the course of these movement phases, the engagement element 39 loses its grip around the hook 37 and, as a result, the locking of the drum circumferential shell 19 with respect to the drum is canceled. On account of its inherent weight, during its removal movement, now also taking place in the drum circumferential direction, the drum circumferential shell 19 still rests on the adjustable carrier 27 or in a guide track or surface 40 of the adjustable carrier 27 that begins in the hook 37 and extends virtually as far as the rotary joint 25. (The other adjustable carrier 28 is equipped with just such a guide track 41, which serves to guide the other drum circumferential shell 20.) The drum circumferential shell 19, therefore, slides with its engagement end 39, which, here, functions as a type of cam follower element, along the partly curvilinearly curved guide track 40. During the sliding movement, the drum circumferential shell 19 is increasingly erected, because of its pivoting movement superimposed on the sliding movement, until the drum circumferential shell 19 has reached its position illustrated by a continuous outline in FIG. 1A.

During the sliding movement, the circumferential shell end that trails during operation, which is fitted with the engagement hook 39, is located within the gripper flight circle 14, and the other, free end of the drum circumferential shell 19 is located outside the gripper flight circle 14. The drum circumferential shell 19, therefore, intersects the gripper flight circle 14 during the removal movement. If, as distinct from the exemplary embodiment shown, the cam follower and engagement element 39 were formed as a roller running on the guide track 40, the term "rolling movement" would apply instead of the term "sliding movement" used above.

In a fourth step, the drum circumferential shell 19 is released completely from the "residual drum", the drum circumferential shell 19 and, now, also the circumferential shell end with the engagement element 39 being raised out of the gripper flight circle 14 and, in the process, the engagement element 39 being lifted off the guide track 40.

In a following fifth step, the sheet transport drum 11 is rotated into a rotary angle position (not illustrated in the drawing) and kept in the latter, the rotary angle position being offset angularly by substantially 180° in relation to that reached in the first step and illustrated in FIG. 1A so that, now, the second drum circumferential shell 20 points upward and can be taken off the sheet transport drum 11.

The method steps necessary to remove the second drum circumferential shell 20 are identical with the second to fourth method steps so that the explanations already provided with respect to the removal of the first drum circumferential shell 19 are also valid in the transferred sense for the removal of the second drum circumferential shell 20.

The removal movements of the drum circumferential shells in 19, 20, which are partly illustrated in FIG. 1A by phantom lines using the example of the drum circumferential shell 19, can be driven and brought about manually by an operator or semi-automatically or fully automatically by a motorized auxiliary device (automatic handler) belonging to the machine 2. Following the removal of both drum circumferential shells 19, 20 from the "residual drum", the latter is set up for the third operating mode.

During the third operating mode, the adjustable carriers 27, 28 remain in their folded-in position, the sheet transport drum ("residual drum") 11 rotates at a rotational speed corresponding to the machine or printing speed and the sheet transport drum 11, by its gripper systems 12, 13 circulating on the gripper flight circle 14, transports the printing material sheets held firmly therein one after another from the upstream impression cylinder 5 to the downstream impression cylinder 6. As long as the sheet transport drum 11 is operating in the third operating mode, its drum circumferential shells 19, 20 can be kept in a circumferential shell store (not illustrated in the drawing) belonging to the machine 2, inside the latter.

After the third operating mode has been completed, the sheet transport drum 11 can be fitted with its drum circumferential shells 19, 20 again, in order, then, to be able to operate in the first or second operating mode again. The refitting of the sheet transport drum 11 with the drum circumferential shells 19, 20 is carried out substantially with respect to the removal method steps explained, in the opposite order and manner.

Figure 2:
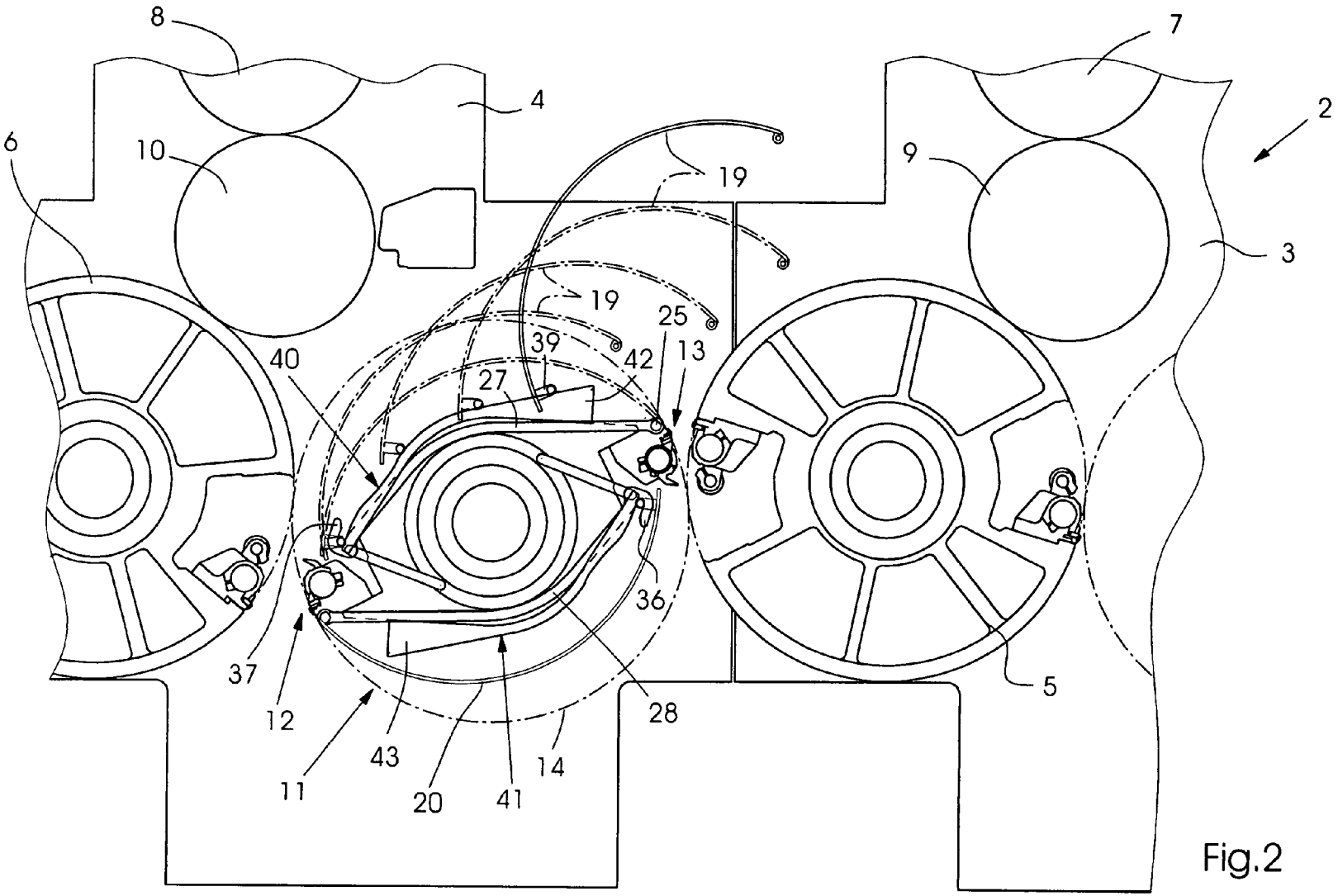
FIG. 2 is fragmentary, cross-sectional view of a second exemplary embodiment of a machine according to the invention in which guides coordinated with the adjustable carriers are used to guide the drum circumferential shells during the drum conversion.

The exemplary embodiment according to FIG. 2 differs only in the guides 42, 43 separate from the adjustable carriers 27, 28 and the formation of the guide tracks 40, 41 on the guides 42, 43 instead of on the adjustable carriers 27, 28 of the exemplary embodiment according to FIGS. 1A and 1B. The other features that the exemplary embodiment according to FIG. 2 has in common with the exemplary embodiment explained previously do not need to be described again in all their details below.

The guides 42, 43 are disposed and shaped such that the guide tracks at 40, 41 in the region of the ends of the guides 42, 43 placed toward the hooks 36, 37 are at the same radial spacing from the axis of rotation 15 as the engagement elements 38, 39 when the adjustable carriers 27, 28 are folded in and the drum circumferential shells 19, 20 are locked in the hooks 36, 37 by their engagement elements 38, 39.

Figure 3A:
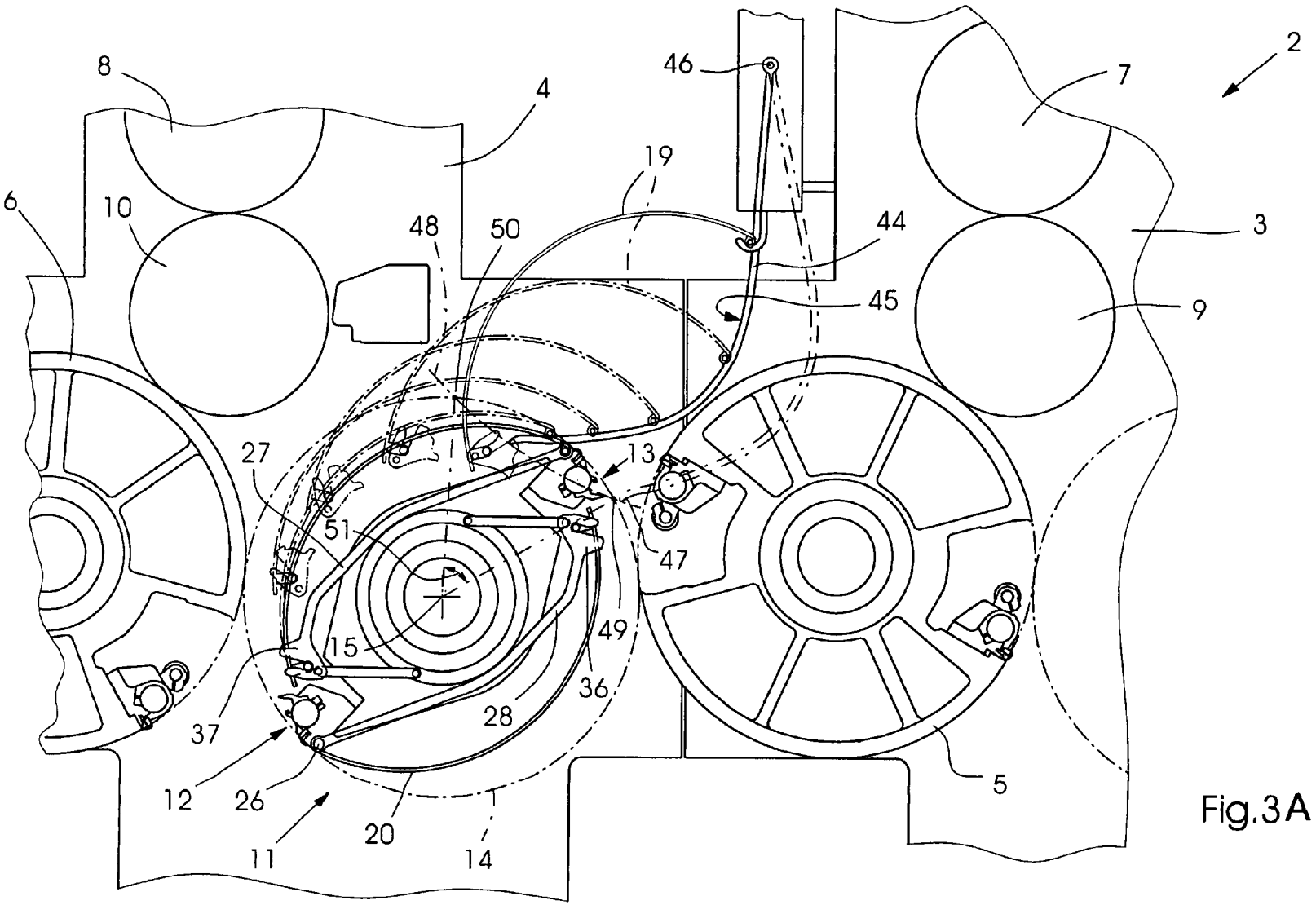
FIG. 3A is fragmentary, cross-sectional view of a third exemplary embodiment of a machine according to the invention in which the drum circumferential shells, with their circumferential shells that lead during printing operation in front, are pushed away from the sheet transport drum by rotational movements of the latter during the drum conversion.
Figure 3B:
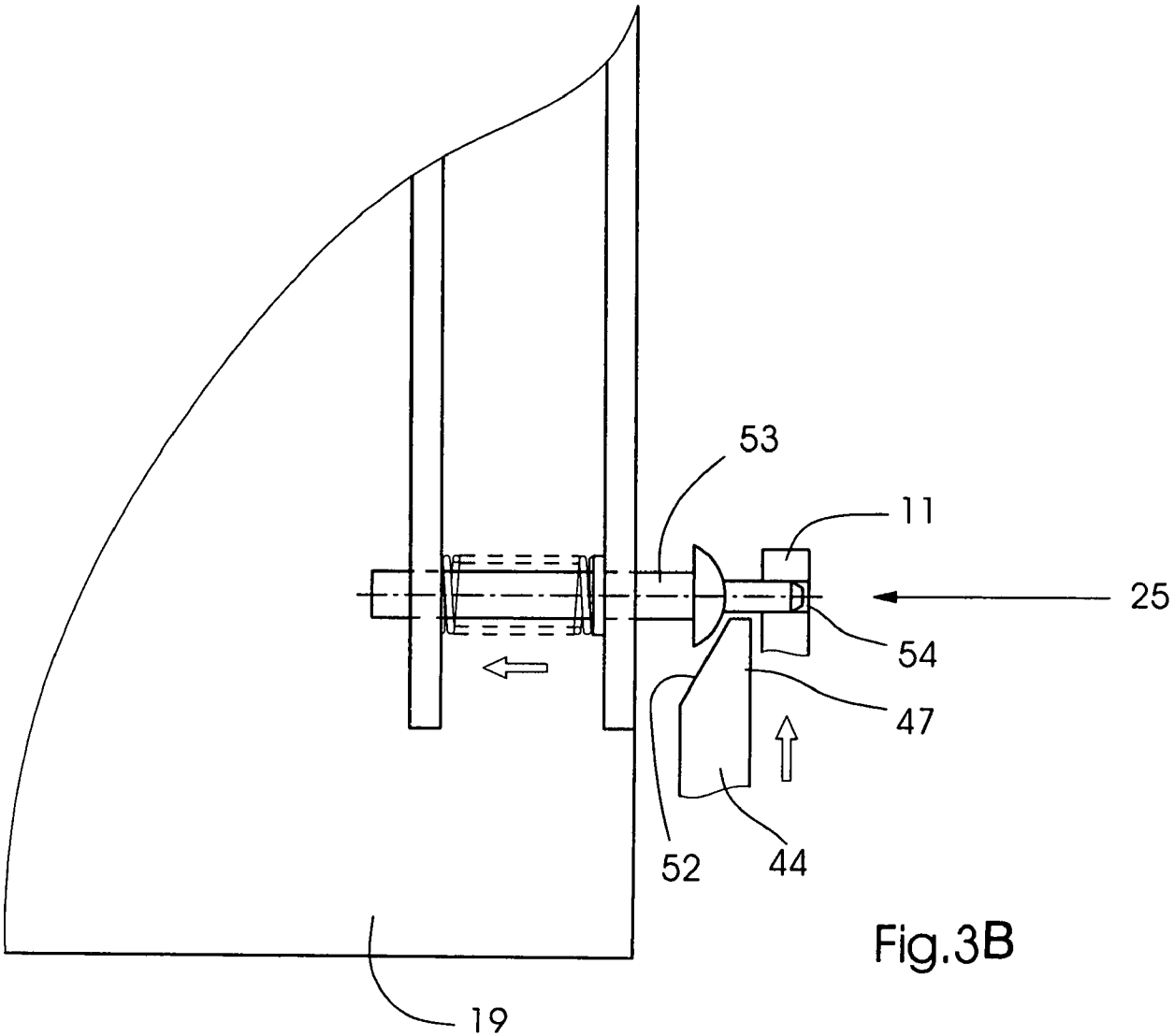
FIG. 3B is a fragmentary, enlarged, cross-sectional view of a holder of the sheet transport drum of FIG. 3A.

It is specific to the exemplary embodiment according to FIGS. 3A and 3B that, beside the sheet transport drum 11, there is disposed a drum circumferential shell guide 44, which is mounted such that it can be adjusted toward the sheet transport drum 11 and away from the sheet transport drum 11 again. The drum circumferential shell guide 44 has a concave guide track 45 for the drum circumferential shells 19, 20 and is mounted such that it can be pivoted about a rotary joint 46 so that, as it is pivoted about the rotary joint 46, its free guide end 47 describes an imaginary pivoting circle 48 that intersects the gripper flight circle 14 at two points of intersection 49, 50. These two points of intersection 49, 50 together with the axis of rotation 15 determine a central angle 51 of the sheet transport drum 11 that is less than 180° and, preferably, also less than 90°. During the removal of the respective drum circumferential shell 19 or 20, in a first step, the sheet transport drum 11 is rotated into its rotary angle position shown in FIG. 3A, in which the holder of the drum circumferential shell 19 or 20, formed by the respective rotary joint 25 or 26, is located between the points of intersection 49, 50 and, thus, within the central angle 51. In the rotary angle position, the sheet transport drum 11 is held as the front holder (rotary joint 25 or 26) of the respective drum circumferential shell 19 or 20 is released. The releasing action is carried out by the drum circumferential shell guide 44 being pivoted towards the front holder into the position of the drum circumferential shell guide 44 illustrated by a continuous line in FIG. 3A and, in the process, with a wedge face 52 formed at a free guide end of the drum circumferential shell guide 44, strikes a spring pin 53 belonging to the front holder and, as a result, forces the spring pin 53 out of a matching hole 54. After that, in a third step, the sheet transport drum 11 is set rotating again so that the sheet transport drum 11 pushes the drum circumferential shell 19 or 20 along the guide 44, as indicated in FIG. 3A by using the different position of the rear holder (hook 37) indicated by phantom lines and the drum circumferential shell 19 still held firmly therein. The drum circumferential shell 19 or 20 slides with the spring pin 53 on the guide track 45 as it is displaced. Ultimately, the engagement element 39 is also released from the hook 36 or 37 so that the drum circumferential shell 19 or 20 can be lifted away from the sheet transport drum 11 by the further pivoting movement of the drum circumferential shell guide 44.

Figure 4:
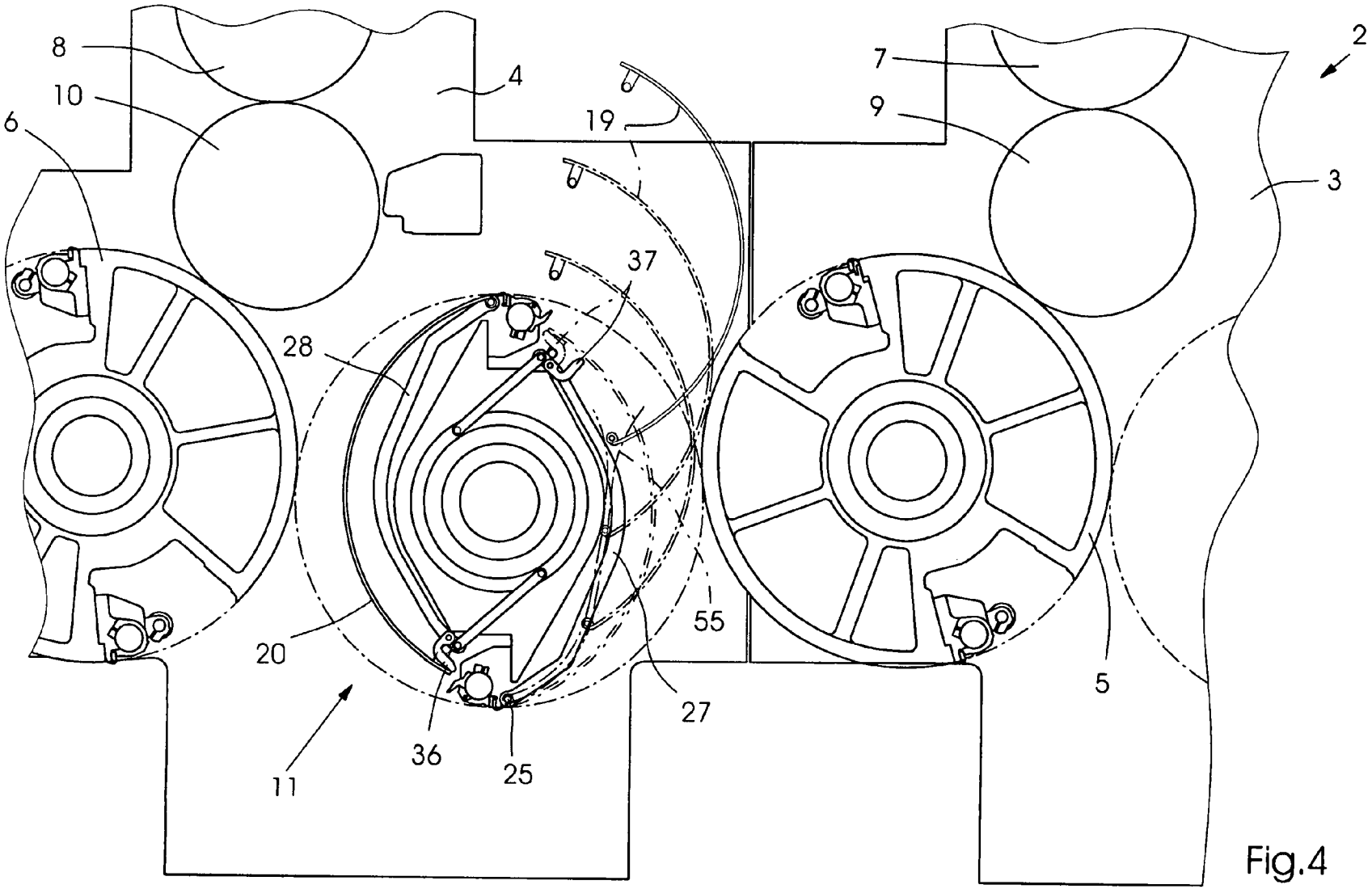
FIG. 4 is fragmentary, cross-sectional view of a fourth exemplary embodiment of a machine according to the invention in which the drum circumferential shells, with their circumferential shells that trail during printing operation in front, being pushed away from the sheet transport drums by rotational movements of the latter during the drum conversion.

In the exemplary embodiment illustrated in FIG. 4, too, a rotational movement of the sheet transport drum 11 is used to push the drum circumferential shells 19, 20 away from the sheet transport drum 11 during the drum conversion. In such a case, in a first step, the holder that trails during printing operation (hook 36 or 37) of the drum circumferential shell 19 or 20 is locked by pivoting the corresponding hook 36, 37 from its position blocking in the radial direction of the drum (indicated by a phantom line in FIG. 4) into a position releasing the drum circumferential shell 19 or 20 radially. As can be seen from FIG. 4, in the locked state, the hooks 36, 37 open in the direction opposite to the direction of rotation of the sheet transport drum 11 that corresponds to printing operation. The alignment of the locked hooks of the exemplary embodiment according to FIG. 4 is, thus, opposite to that of the hooks of the exemplary embodiment according to FIGS. 1A and 1B. After the rear holder has been released, the sheet transport drum 11 is rotated in the direction of rotation that is opposite relative to printing operation (in the counterclockwise direction with respect to FIG. 4) so that the drum circumferential shell 19 or 20 respectively to be removed is pushed away from the sheet transport drum 11 with its rear circumferential shell in front. In the process, the rear holder (rotary joint 25 or 26) is also released and guided by a guide 55 that is disposed beside the sheet transport drum 11 and does not co-rotate with the latter.

This application claims the priority, under 35 U.S.C. § 119, of German patent application No. 103 27 422.7, filed Jun. 18, 2003; the entire disclosure of the prior application is herewith incorporated by reference.

We claim:

1. A method of operating a machine processing printing material sheets, which comprises:

providing a sheet transport drum of the printing machine with drum circumferential shells;

operating the sheet transport drum in various operating modes;

in a first of the operating modes, fixing the drum circumferential shells in an outer position on the sheet transport drum at a distance from an axis of rotation of the drum;

in a second of the operating modes, fixing the drum circumferential shells in an inner position on the sheet transport drum at a distance from the axis of rotation of the drum being less than the distance in the outer position;

providing the sheet transport drum with adjustable carriers being swinging arms of coupler mechanisms;

in the first and second operating modes, carrying the drum circumferential shells with the adjustable carriers;

before a start of a third of the operating modes, removing the drum circumferential shells from the sheet transport drum during a drum conversion; and in the third operating mode, rotating the sheet transport drum without the drum circumferential shells.

2. The method according to claim 1, which further comprises, during a change in an operating mode carried out between the first and second operating modes, adjusting each of the drum circumferential shells, together with a respective one of the adjustable carriers, into one of the inner and outer positions.

3. The method according to claim 1, which further comprises, during the drum conversion, guiding the drum circumferential shells with the adjustable carriers by moving the drum circumferential shells along the adjustable carriers and guiding the drum circumferential shells with the adjustable carriers during the movement.

4. The method according to claim 1, which further comprises:

disposing guides separately from the adjustable carriers on the sheet transport drum; and during the drum conversion, guiding the drum circumferential shells with the guides by moving the drum circumferential shells along the guides and guiding the drum circumferential shells with the guides.

5. The method according to claim 3, which further comprises respectively guiding the drum circumferential shells with the sheet transport drum not rotating.

6. The method according to claim 1, which further comprises, during the drum conversion, pushing the drum circumferential shells away from the sheet transport drum by rotational movements of the sheet transport drum.

7. The method according to claim 1, which further comprises:

in the first and second operating modes, holding the drum circumferential shells on the sheet transport drum with holders; and during the drum conversion, automatically releasing the holders by a respective relative movement carried out between the sheet transport drum and at least one machine element separate from the sheet transport drum.

8. The method according to claim 7, which further comprises utilizing a drum circumferential shell guide as the machine element.

9. The method according to claim 1, which further comprises, in the third operating mode, transporting the printing material sheets with the rotating sheet transport drum.

10. The method according to claim 1, which further comprises, in the third operating mode, rotating the sheet transport drum for maintenance.

* * * * *